US006474937B1

(12) United States Patent
Rothkopf et al.

(10) Patent No.: US 6,474,937 B1
(45) Date of Patent: Nov. 5, 2002

(54) LIQUID PUMP, ESPECIALLY FOR DELIVERING FUEL

(75) Inventors: Johann Rothkopf, Finsing (DE); Luciano Zorzin, Ebersberg (DE); Dirk Bruhs, Brunnthal (DE)

(73) Assignee: Robert Bosch GmbH, STuttgart (DE)

( * ) Notice: Subject to any disclaimer, the term of this patent is extended or adjusted under 35 U.S.C. 154(b) by 0 days.

(21) Appl. No.: 09/762,656

(22) PCT Filed: May 4, 2000

(86) PCT No.: PCT/DE00/01427

§ 371 (c)(1),
(2), (4) Date: Feb. 12, 2001

(87) PCT Pub. No.: WO00/79133

PCT Pub. Date: Dec. 28, 2000

(30) Foreign Application Priority Data

Jun. 18, 1999 (DE) ..... 199 27 789

(51) Int. Cl.[7] ..... F01D 1/12
(52) U.S. Cl. ..... 415/55.1
(58) Field of Search ..... 415/55.1–55.7; 417/423.3, 423.14

(56) References Cited

U.S. PATENT DOCUMENTS 3,392,675 A * 7/1968 Taylor ..... 415/55.4
3,951,567 A * 4/1976 Rohs ..... 415/119
5,017,086 A 5/1991 Hansen
5,642,981 A * 7/1997 Kato et al. ..... 415/55.1
5,772,393 A 6/1998 Nakamura
5,785,490 A 7/1998 Dobler
6,082,984 A * 7/2000 Matsumoto et al. ..... 418/171

FOREIGN PATENT DOCUMENTS

DE 15 28 704 A 5/1969
DE 195 04 564 A 8/1996
EP 0 397 041 A 11/1990

* cited by examiner

*Primary Examiner*—Edward K. Look
*Assistant Examiner*—Ninh Nguyen
(74) *Attorney, Agent, or Firm*—Michael J. Striker

(57) ABSTRACT

The fluid pump has an impeller (10), provided with vanes (12) and driven to rotate in a pump chamber. The pump chamber is defined in the direction of the pivot axis (18) of the impeller (10) by wall parts (24), in each end face (25) of which toward the impeller (10) there is one annular feed conduit (32). An intake opening discharges in the region of the beginning of the feed conduit of one wall part, and an outlet opening (34) discharges in the region of the end of the feed conduit (32) of the other wall part (24). The outlet opening (34) is embodied as elongated in the circulation direction (11) of the impeller (10), and in the radial direction with respect to the pivot axis (18) of the impeller (10), it has a width (b) that is less than the width (B) of the feed conduit (32) in the radial direction. Instead of the elongated outlet opening (34), it is also possible for a plurality of separate outlet openings to be provided, which are offset from one another in the circulation direction (11) of the impeller (10).

13 Claims, 2 Drawing Sheets

LIQUID PUMP, ESPECIALLY FOR DELIVERING FUEL

PRIOR ART

The invention is based on a fluid pump, in particular for pumping fuel, as generically defined by the preamble to claim 1.

One such fluid pump is known from German Patent Disclosure DE 195 04 564 A1. This fluid pump has a pump impeller provided with vanes and driven to rotate. The pump impeller is disposed in a pump chamber that is defined in the direction of the pivot axis of the pump impeller by a respective wall part. An intake opening is embodied in one wall part, and an outlet opening is embodied in the other wall part. One annular feed conduit is disposed in each of the end faces, toward the pump impeller, of the wall parts. The intake opening discharges in the region of the beginning of the feed conduit of one wall part, and the outlet opening discharges in the region of the end of the feed conduit of the other wall part. In the radial direction with respect to the pivot axis of the pump impeller, the outlet opening has a width that is at least as great as the width of the feed conduit in the radial direction. It has been found that in this known fluid pump, an irritating amount of noise occurs under some circumstances, especially in the form of a high-frequency whistling sound, which is caused as the pumped fluid flows out through the outlet opening.

ADVANTAGES OF THE INVENTION

The fluid pump of the invention having the characteristics of claim 1 or of independent claim 3 has the advantage over the prior art that noise production upon an outflow of fluid through the at least one outlet opening is averted or at least diminished.

Advantageous features and refinements of the fluid pump of the invention are recited in the dependent claims.

DRAWING

Two exemplary embodiments of the invention are shown in the drawing and described in further detail in the ensuing description.

DESCRIPTION OF THE EXEMPLARY EMBODIMENTS

Figure 1:
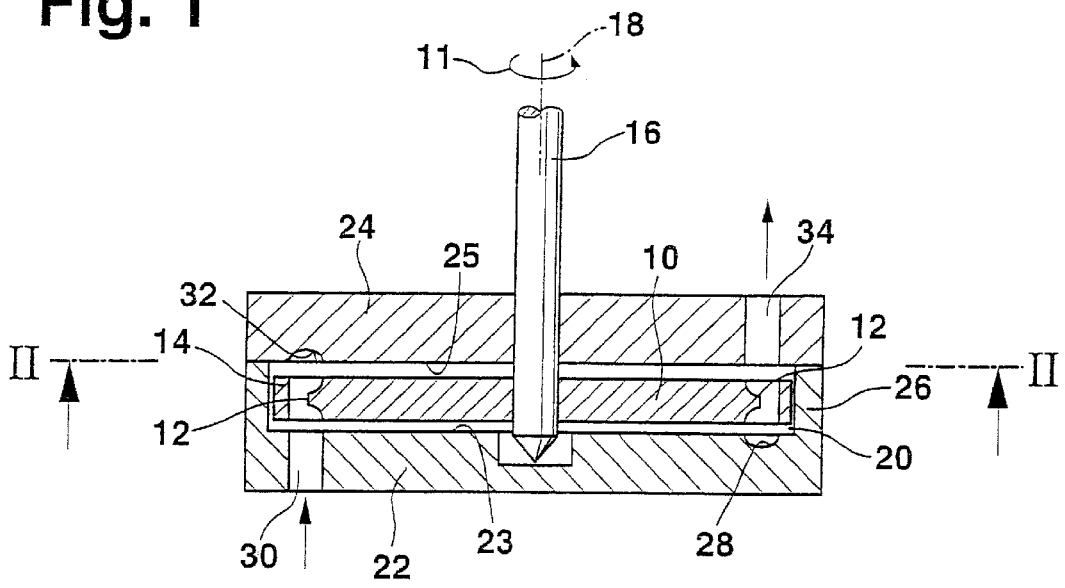
FIG. 1 shows a fluid pump in an axial longitudinal section.
Figure 2:
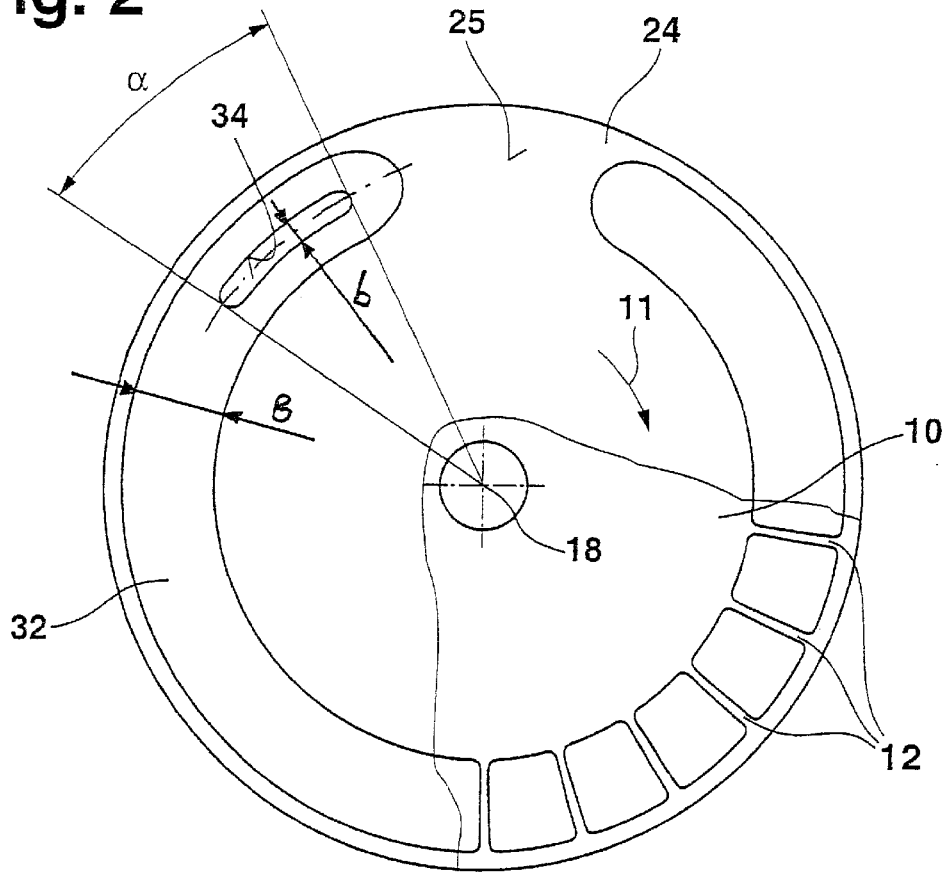
FIG. 2 shows the fluid pump in a cross section taken along the line II–II of FIG. 1, in an enlarged view showing a first exemplary embodiment.
Figure 3:
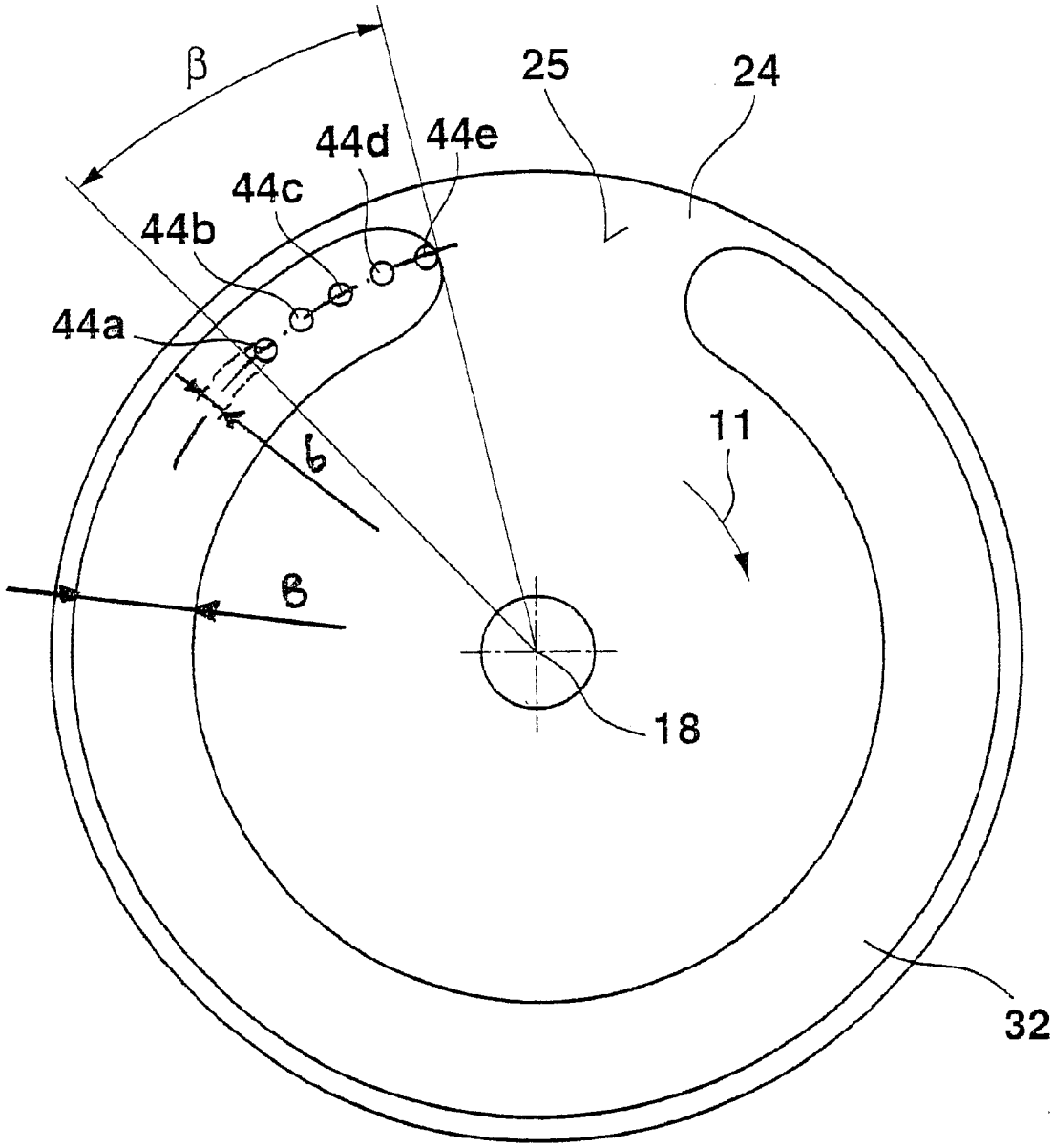
FIG. 3 shows the fluid pump in cross section in accordance with a second exemplary embodiment.

A fluid pump shown in FIGS. 1–3 serves in particular to pump fuel out of a tank to the internal combustion engine of a motor vehicle. The fluid pump is combined with an electric drive motor, not shown, to form a pump assembly, and the fluid pump and drive motor are disposed in a common housing. The fluid pump has a pump impeller 10, which beginning at its two face ends has two rings of vanes 12 or blades, spaced apart from another and distributed over the circumference of the pump impeller 10. The vanes 12 can be joined to one another via a ring 14 on their radially outer ends. The vanes 12 can be embodied as flat or can be disposed radially or inclined to a radial direction with respect to the pivot axis of the impeller and can also alternatively be embodied in curved form. The impeller 10 is driven to rotate about an axis 18 by the drive motor, not shown, for instance via a shaft 16. The impeller 10 is disposed in a pump chamber 20, which is defined in the direction of the pivot axis 18 of the impeller 10 by two wall parts 22 and 24 spaced apart from one another. In the radial direction with respect to the pivot axis 18, the pump chamber 20 is defined by a hollow-cylindrical wall part 26, which can be disposed as a separate ring between the wall parts 22 and 24, or as shown in FIG. 1 can be embodied integrally with one of the wall parts 22, 24. The wall part 24 disposed toward the drive motor is embodied as an intermediate housing, and the other wall part 22 is embodied as an intake cap. The shaft 16 that drives the impeller 10 protrudes through the intermediate housing 24 into the pump chamber 20. The wall parts 22, 24, 26 may for instance comprise plastic, metal and especially lightweight cast metal, ceramic material, or some other suitable material.

An annular feed conduit 28, which is opposite the ring of vanes 12 of the impeller 10, is embodied in the end face 23, toward the impeller 10, of the intake cap 22. An intake opening 30, which is open toward the outside of the fluid pump, discharges into the region of the beginning of the feed conduit 28 in the intake cap 22. An annular feed conduit 32, also opposite the ring of vanes 12 of the impeller 10, is embodied in the end face 25, toward the impeller 10, of the intermediate housing 24, and at least one outlet opening 34 discharges in the region of the end of this feed conduit. The feed conduits 28 and 32, viewed in the direction of the pivot axis 18, are disposed approximately congruently and extend in the circulation direction 11 of the impeller 10 from the intake opening 30 as far as the at least one outlet opening 34. In the region between their beginning and end, in terms of the circulation direction 11, the feed conduits 28 and 32 are separated from one another by a respective interrupter 29 and 33. The feed conduits 28 and 32 may be rounded in cross section, for example, or can have any arbitrary other cross-sectional shape. In operation of the fluid pump, fuel is aspirated by it from the supply container through the intake opening 30; in the feed conduits 28 and 32, the pressure of the fuel is raised, and through the at least one outlet opening 34, the fuel flows out of the pump chamber 20. The fuel flowing out of the at least one outlet opening 34 flows through the drive motor and emerges from the housing of the pump assembly through a stub, to which a line leading to the engine is connected.

In FIG. 2, the fluid pump is shown enlarged in a cross section showing a first exemplary embodiment. In the fluid pump of the first exemplary embodiment, only one outlet opening 34 is provided. The outlet opening 34 is embodied as elongated in the circulation direction 11 of the impeller 10, and in the radial direction with respect to the pivot axis 18 of the impeller 10, it has a width b that is less than the width B of the feed conduit 32 in the radial direction. The width b of the outlet opening 34 is approximately 0.2 to 0.8 and preferably 0.4 to 0.6 times the width B of the feed conduit 32. The outlet opening 34 is preferably disposed at least approximately centrally on the bottom of the feed conduit 32, in terms of the radial direction with respect to the pivot axis 18 of the impeller 10. The outlet opening 34 is curved and extends at least approximately in the form of an arc segment of a circle that is coaxial with the pivot axis 18 of the impeller 10. In the circulation direction 11 of the impeller 10, the outlet opening 34 extends over an angle $\alpha$ of approximately 10° to 40°, preferably approximately 20° to 30°. The outlet opening 34 can extend, in terms of the circulation direction 11 of the impeller 10, as far as the end of the feed conduit 32, or as shown in FIG. 2, it can already end somewhat before the end of the feed conduit 32. The edges of the outlet opening 34 in the circulation direction 11 and counter to the circulation direction 11 are preferably rounded, but can also be disposed approximately radially to the pivot axis 18 or can taper to a point. By means of the elongated embodiment of the outlet opening 34 in the circulation direction 11 of the impeller, no annoying noises occur as the fuel flows out through it.

In FIG. 3, the fluid pump is shown enlarged in a cross section of a second exemplary embodiment. In the fluid pump of the second exemplary embodiment, a plurality of outlet openings 44 are provided. In the exemplary embodiment shown, five outlet openings 44*a, b, c, d, e* are shown, but it is also possible for fewer or more than five outlet openings 44 to be provided. The outlet openings 44*a, b, c, e* are offset from one another in the circulation direction 11 of the impeller 10 and are separate from one another. The outlet openings 44*a, b, c, e* have a width b in the radial direction, with respect to the pivot axis 18 of the impeller 10, that is less than the width B of the feed conduit 32 in the radial direction. The width b of the outlet openings 44*a, b, c, e* amounts to approximately 0.2 to 0.8, and preferably 0.2 to 0.6, times the width B of the feed conduit 32. The outlet openings 44*a, b, c, d, e* are distributed in the circulation direction 11 of the impeller 10 over an angle β of approximately 10° to approximately 50°, and preferably approximately 20° to 40°. The angular spacings between the individual outlet openings 44*a, b, c, e* can each be the same or can vary. The outlet openings 44*a, b, c, e* are preferably distributed over a circular arc segment that is at least approximately coaxial to the pivot axis 18 of the impeller 10. The outlet openings 44*a, b, c, e* are preferably disposed at least approximately centrally on the bottom of the feed conduit 32, in the radial direction with respect to the pivot axis 18 of the impeller 10. The last outlet opening 44*e* in terms of the circulation direction 11 of the impeller 10 can be disposed at the end of the feed conduit 32, as shown in FIG. 3, or can alternatively be disposed before the end of the feed conduit 32. By way of example, the outlet openings 44*a, b, c, e* have a round cross section, and they can be made in the form of bores in the intermediate housing 24. The outlet openings 44*a, b, c, d, e* can also have some arbitrary other cross-sectional shape and can be formed in the production of the intermediate housing 24. The intermediate housing 24 may for instance comprise plastic and be made by injection molding. The size of each of the outlet openings 44*a, b, c, e* can be the same or can vary.

Because of the outlet openings 44*a, b, c, e* distributed in the circulation direction 11 of the impeller 10, no irritating noises occur as the fuel flows out through them.

What is claimed is:

1. A fluid pump, in particular for pumping fuel, having a pump impeller (10), driven to rotate and provided with vanes (12), which is disposed in a pump chamber (20) defined in the direction of its pivot axis (18) by respective wall parts (22, 24), having an intake opening (30) in one wall part (22) and an outlet opening (34) in the other wall part (24), having an annular feed conduit (28, 32) respectively disposed in end faces (23, 25), toward the pump impeller (10), of the wall parts (22, 24), wherein the intake opening (30) discharges in the region of the beginning of the feed conduit (28) of the one wall part (22) and the outlet opening (34) discharges in the region of the end of the feed conduit (32) of the other wall part (24), characterized in that the outlet opening (34) is embodied as elongated in the circulation direction (11) of the pump impeller (10) and in the radial direction has a width (b), with respect to the pivot axis (18) of the pump impeller (10), that is less than the width (B) of the feed conduit (32) in the radial direction in an area around the outlet opening (34).

2. The fluid pump of claim 1, characterized in that wherein the outlet opening (34) extends in the circulation direction (11) of the pump impeller (10) over an angle (α) of between approximately 10° and 40°.

3. The fluid pump of claim 1, characterized in that the width (b) of the outlet opening (34) is approximately 0.2 to 0.8 times the width (B) of the feed conduit (32).

4. The fluid pump of claim 1, characterized in that the outlet opening (34) is disposed at least approximately centrally to the feed conduit (32) with respect to the pivot axis (18) of the pump impeller.

5. The fluid pump of claim 1, characterized in that the outlet opening (34) extends in the circulation direction (11) of the pump impeller (10) over an angle (α) of between approximately 20° and 30°.

6. The fluid pump of claim 1, characterized in that the width (b) of the outlet opening (34) is approximately 0.2 to 0.6 times the width (B) of the feed conduit (32).

7. A fluid pump, in particular for pumping fuel, having a pump impeller (10), driven to rotate and provided with vanes (12), which is disposed in a pump chamber (20) defined in the direction of its pivot axis (18) by respective wall parts (22, 24), having an intake opening (30) in one wall part (22) and at least one outlet opening (44*a, b, c, e*) in the other wall part (24), having an annular feed conduit (28, 32) respectively disposed in the end faces (23, 25), toward the pump impeller (10), of the wall parts (22, 24), wherein the intake opening (30) discharges in the region of the beginning of the feed conduit (28) of the one wall part (22) and the at least one outlet opening (44*a, b, c, d, e*) discharges in the region of the end of the feed conduit (32) of the other wall part (24), characterized in that a plurality of outlet openings (44*a, b, c, e*) are provided, which are disposed offset from one another in the circulation direction (11) of the pump impeller (10).

8. The fluid pump of claim 7, characterized in that the outlet openings (44*a, b, c, e*) have a width (b) in the radial direction with respect to the pivot axis (18) of the pump impeller (10) that is less than the width (B) of the feed conduit (32) in the radial direction.

9. The fluid pump of claim 7, characterized in that the at least one outlet opening (44*a, b, c, e*) in the outer wall are distributed in the circulation direction (11) of the pump impeller (10) over an angle (β) of between approximately 10° and 50°.

10. The fluid pump of claim 7, characterized in that the at least one outlet opening (44*a, b, c, e*) are distributed in the circulation direction (11) of the pump impeller (10) over an angle (β) of between approximately 20° and 40°.

11. The fluid pump of claim 7, characterized in that the width (b) of the at least one outlet opening (44*a, b, c, e*) is approximately 0.2 to 0.8 times the width (B) of the feed conduit (32).

12. The fluid pump of claim 7, characterized in that the width (b) of the at least one outlet opening (44*a, b, c, e*) is approximately 0.2 to 0.6 times the width (B) of the feed conduit (32).

13. The fluid pump of claim 7, characterized in that the at least one outlet opening (44*a, b, c, e*) is disposed at least approximately centrally to the feed conduit (32) with respect to the pivot axis (18) of the pump impeller (10).

* * * * *